United States Patent [19]

Fenne

[11] 4,082,481

[45] Apr. 4, 1978

[54] FUEL INJECTION PUMPING APPARATUS

[75] Inventor: Ivor Fenne, Greenford, England

[73] Assignee: CAV Limited, Birmingham, England

[21] Appl. No.: 768,377

[22] Filed: Feb. 14, 1977

Related U.S. Application Data

[63] Continuation of Ser. No. 660,927, Feb. 24, 1976, abandoned.

[51] Int. Cl.[2] ..... F04B 17/00

[52] U.S. Cl. ..... 417/403; 123/139 AS

[58] Field of Search ..... 417/46, 560, 507, 390, 417/398–401, 344–346, 322, 289; 91/50; 60/584; 123/139 R, 139 AS, 139 E

[56] References Cited

U.S. PATENT DOCUMENTS

| | | | |
|---|---|---|---|
| 3,481,587 | 12/1969 | Ruhnau | 417/390 X |
| 3,487,783 | 1/1970 | Curran et al. | 417/399 X |
| 3,500,799 | 3/1970 | Benson | 123/32 EA |
| 3,592,176 | 7/1971 | Fenne | 123/139 AS |
| 3,919,989 | 11/1975 | Jarrett et al. | 123/139 R |

FOREIGN PATENT DOCUMENTS

| | | | |
|---|---|---|---|
| 1,909,793 | 9/1970 | Germany | 417/293 |

*Primary Examiner*—William L. Freeh
*Assistant Examiner*—Edward Look
*Attorney, Agent, or Firm*—Holman & Stern

[57] ABSTRACT

A fuel injection pumping apparatus includes a displacement piston housed within a cylinder and movable towards one end of the cylinder to effect injection of fuel to an associated engine. The displacement piston is moved by a fluid pressure operable member and valve means is provided to control the application of fuel pressure to the member from a source. There is interposed between the valve means and the cylinder containing the fluid pressure operable member, a variable orifice which acts to limit at least the initial rate of movement of the displacement member thereby to control the initial rate of injection of fuel.

6 Claims, 1 Drawing Figure

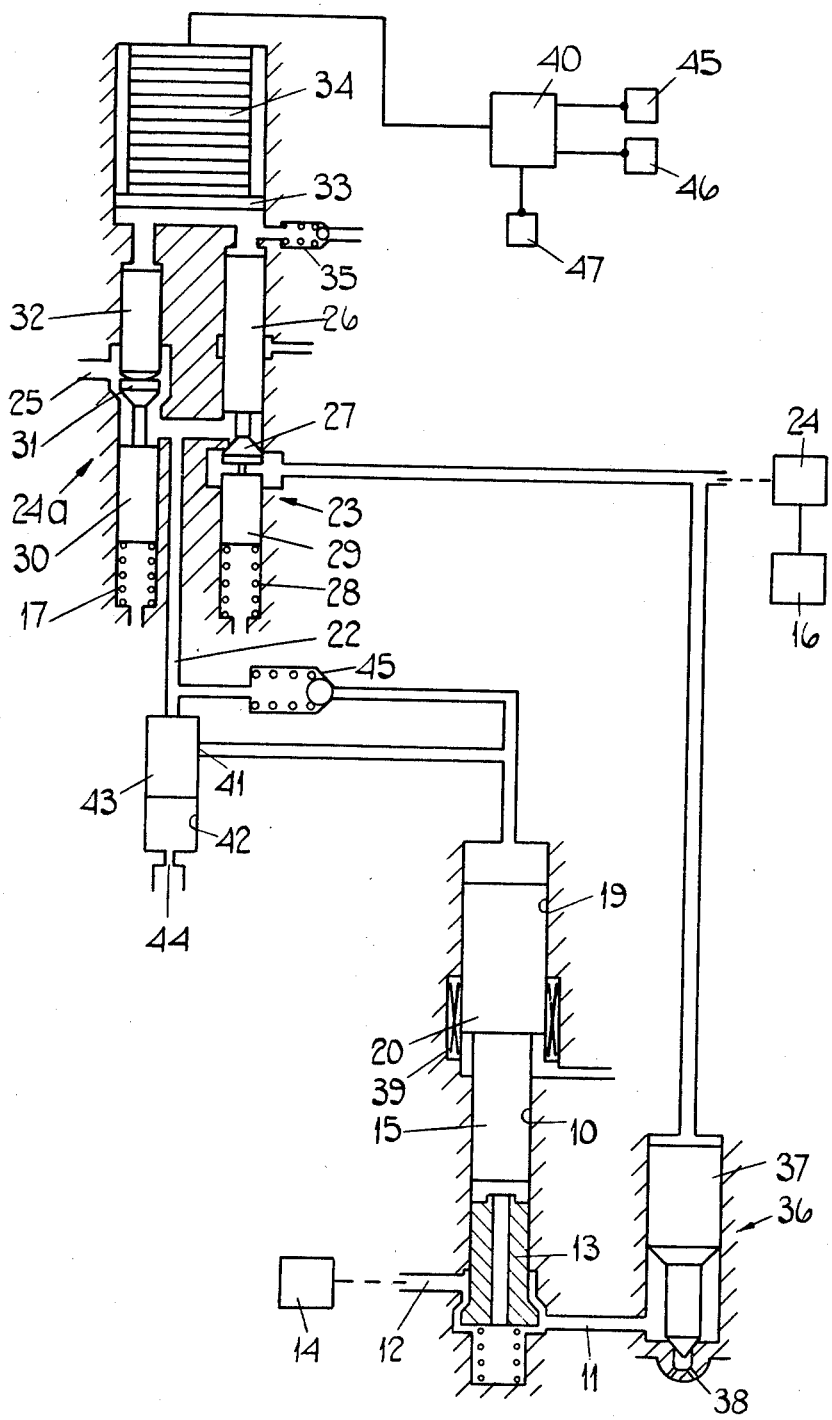
34
40
45
33
46
35
47
32
26
25
31
27
24
24a
23
30
29
28
17
16
22
45
43
41
42
44
19
20
39
15
10
37
36
13
14
12
11
38

FUEL INJECTION PUMPING APPARATUS

This is a continuation of application Ser. No. 660,927, filed Feb. 24, 1976, now abandoned.

This invention relates to fuel injection pumping apparatus for supplying fuel to internal combustion engines.

In the complete specification of application Ser. No. 471,688 there is described a fuel injection pumping apparatus which comprises in combination, a displacement piston located within a cylinder, an outlet from one end of the cylinder, a fluid pressure operable member mounted within a further cylinder for actuating said piston and causing fuel to be delivered through said outlet, means operable upon movement of the piston to a predetermined position in said cylinder during delivery of fuel through said outlet by the piston, to terminate flow of fuel through the outlet and valve means operable to place an end of said further cylinder in communication with a source of fluid under pressure to effect movement of the displacement piston in a direction to deliver fuel through said outlet, or with a drain to permit return motion of the piston.

The object of the invention is to provide such an apparatus in a simple and convenient form.

According to the invention, an apparatus of the kind specified comprises an adjustable orifice disposed intermediate said valve means and said one end of said further cylinder, said adjustable orifice acting to control at least the initial flow of fluid to said one end of said further cylinder thereby to control the rate of fuel supply through said outlet, and a non-return valve disposed in parallel with said orifice, said non-return valve being arranged to permit substantially unrestricted flow of liquid out of said end of the further cylinder.

One example of an apparatus in accordance with the invention will now be described with reference to the accompanying drawing which shows the apparatus in diagrammatic form.

Referring to the drawing, there is provided a cylinder 10 one end of which communicates with an outlet 11 and a fuel inlet 12, the latter being connected to a source of fuel 14 there being provided within the cylinder 10, a valve element 13 which is spring loaded to the closed position but which as will be described, can be opened mechanically or by fuel under pressure supplied through the inlet 12. Located within the cylinder 10 is a displacement piston 15. A further cylinder 19 is provided, and this is disposed co-axially with the cylinder 10 and contains a fluid pressure operable member in the form of a piston 20. The cylinder 19 is larger in diameter than the cylinder 10 and the space surrounding the portion of the displacement piston 15 which is located within the cylinder 19, is vented to a drain.

The other end of the further cylinder 19 is connected to a passage 22 which can be connected by way of a first valve 23 to an accumulator 24 which contains liquid, preferably fuel at a high pressure. The accumulator 24 is charged by means of a high pressure pump 16 driven by the associated engine. Alternatively, the passage 22 may be connected by way of a valve **24*a* to a drain passabe 25**.

The valve 23 includes a pressure actuated valve member 26 having an integral head 27. The head 27 is loaded into contact with the seating by means of a coiled compression spring 28 and in this position the supply of liquid from the accumulator 24 to the passage 22 is broken. In addition, the valve member 26 is provided with a pressure balancing element 29 to which it is connected by a narrow stem.

The second valve **24*a* includes a slidable valve element 30 including a head 31 which can co-operate with a seating to prevent flow of liquid from the passage 22 to a drain passage 25. The valve element 30 is spring loaded by means of a spring 17 in a direction to open the valve, and it is moved to the closed position by means of a valve actuating piston 32. The piston 32 can be subjected to a fluid pressure developed by a piston 33 which is operated by a stack 34 of piezo-electric crystals. In addition, the pressure developed by the piston 33 is applied to the valve member 26. The piston 33 is moved to develop the pressure by energising the stack of crystals, and it has the effect of closing the valve 24*a* and opening the valve 23. The cylinder occupied by the piston 33 together with the chambers communicating therewith are maintained full of liquid conveniently fuel, by way of a non-return valve 35 connected to the source of fuel 14**.

As shown in the drawing, the outlet 11 is connected to an injection nozzle 36 which includes a differential valve 37 of the usual type. This valve is urged into contact with a seating to prevent flow of fuel through orifices 38 into a combustion space of an associated engine, by the application of fluid pressure from the accumulator 24.

In operation, the valves 23 and **24*a* are shown in the position which they adopt during return motion of the displacement piston 15 and the piston 20, such return motion being due to flow of fuel into the chamber 10 past the valve 13 which is moved during this time against the action of its spring loading, to permit fuel to flow into the cylinder. After a predetermined movement as will be explained, the stack of crystals 34 is partly energised and the piston 33 develops a fluid pressure which is sufficient to effect reversal of the position of the valve 24*a*. Valve 23 remains unaffected because the force exerted by the spring 28 is higher than that exerted by the spring 17. The valves remain in this position until the desired time for injection whereupon the stack of crystals is fully energised and the increased pressure opens the valve 23. In this situation, pressure from the accumulator 24 is applied to the end of the piston 20 and this effects movement of the displacement piston 15 so as to pressurise the fuel in the outlet 11. When a predetermined pressure has been reached which it will be understood, is higher than the accumulator pressure by reason of the differing areas of the pistons 15 and 20, the valve member of the injector 36 is lifted and flow of fuel occurs through the outlet 11 and through the orifices 38** to a combustion space of the associated engine.

The flow of fuel through the orifices 38 occurs until such time as the displacement piston 15 contacts the valve element 13. When this takes place the valve element 13 is lifted from its seating, and the pressure in the outlet 11 falls to the outlet pressure of the source 14. The effect of this is to ensure that the valve 37 of the injector closes quickly. In addition, any surplus fuel in the cylinder 10 is discharged to the source 14.

The stack of crystals 34 is maintained in its fully energised state for a sufficient length of time to allow the pressure in passage 11 to fall to the feed pressure of the source 14. When this has occurred, the crystals are de-energised and the valves 23 and **24*a* return to the positions shown in the drawing. The displacement piston 15 and the piston 20 now move under the action of the fuel supplied through the inlet 12 by the source 14. The time allowed for the return motion as described determines the amount of fuel which is supplied to the engine, and this is carefully controlled by an electronic control circuit indicated at 40, which supplies electrical power to the stack of crystals 34. When it is required to deliver more fuel to the engine, the displacement piston and the piston 20 are allowed a longer time for their return motion. The stroke of the member 20 is sensed by a sensing coil 39 and the signal developed by this coil is applied to the electronic control circuit. The electronic control circuit also receives signals indicative of a demand such for instance as engine speed and an actual engine operating parameter such for instance as the actual engine speed as well as a signal indicative of the position of the engine parts to ensure that the timing of injection occurs at the correct time. These signals are provided by transducers 45, 46, 47** respectively.

In order to control the rate at which fuel is initially supplied to the engine, an adjustable orifice is provided in the passage 22 between the valves 23 and 24 and the end of the cylinder 19. As shown in the drawing, the orifice is defined by a port 41 formed in the wall of a cylinder 42. The port 41 is positioned to be progressively uncovered as fuel is supplied to the cylinder 19, by means of a piston element 43. The pressure of fuel from the accumulator is applied to one end of the piston element 43, and the rate of escape of fuel from the other end of the cylinder 42 is determined by a sharp edged orifice 44. Fuel escaping through the orifice 44 flows to the source of fuel 14 and the shape of the port 41 is such that the desired initial rate of flow from the orifices 38 is achieved. It will be appreciated that after a predetermined movement of the piston element 43, the port 41 offers substantially no resistance to the flow of fuel so that only the initial flow of fuel through the orifices 38 takes place at a restricted rate. When the valve 23 is closed the piston element 43 will return under the action of fuel under pressure from the source 14, and furthermore, the port 41 will be progressively closed. In order to permit the pistons 15 and 20 to return under the action of fuel flowing to the cylinder 10 from the source 14, a non-return valve 45 is provided and this opens to permit substantially unrestricted movement of the pistons 15 and 20.

In the arrangement shown in FIG. 1, the port 41 is positioned so that a limited movement of the valve element 43 must occur before the port 41 starts to be uncovered. The provision of this small movement before the port 41 is uncovered enables the apparatus described to be operated so as to provide pilot injection of fuel. By pilot injection we mean that a small volume of fuel is delivered through the orifices 38 followed by an interval in which no fuel is delivered, and then follwed by the main injection of fuel. In order to achieve the pilot injection of fuel, a slight modification to the control circuit 40 is required so that when injection of fuel is required, the stack of crystals 34 is momentarily fully energised and is then de-energised so that the valve 23 is opened and then quickly closed. The effect of opening the valve 23 quickly and then reclosing it, is to pressurise the volume of fuel contained in the portions of the valves 23 and 24 together with the portion of the passage 22 upstream of the cylinder 42 and this pressurisation results in compression of the fuel in the spaces which thereby act as a reservoir for fuel. The time during which the valve 23 is open is extremely short, and no appreciable movement of the valve element 43 occurs during this time. However, due to the fact that the spaces are acting as a reservoir, even when the valve 23 has closed the piston 43 continues to move and the point is reached at which the port 41 is opened. The stored fuel then causes movement of the piston 20, and thereby a discharge of fuel occurs through the orifices 38. By controlling the volume of the aforesaid spaces, the amount of fuel constituting the pilot injection can be controlled.

I claim:

1. A fuel injection pumping apparatus comprising in combination a displacement piston located within a cylinder, an outlet from one end of the cylinder, a fluid pressure operable member mounted within a further cylinder for actuating said piston and causing fuel to be delivered through said outlet, means operable upon movement of the piston to a predetermined position in said cylinder during delivery of fuel through said outlet by the piston, to terminate flow of fuel through the outlet and valve means operable to place an end of said further cylinder in communication with a source of fluid under pressure to effect movement of the displacement piston in a direction to deliver fuel through said outlet, or with a drain to permit return motion of the piston, an adjustable orifice disposed intermediate said valve means and said one end of said further cylinder, said adjustable orifice acting to control at least the initial flow of fluid to said one end of said further cylinder thereby to control the rate of fuel supply through said outlet, and a non-return valve disposed in parallel with said orifice, said non-return valve being arranged to permit substantially unrestricted flow of liquid out of said end of the further cylinder, and in which said adjustable orifice is defined by a port formed in the wall of an additional cylinder, said port communicating with said one end of said further cylinder, an inlet to one end of said additional cylinder, and through which liquid can flow to said further cylinder by way of the port when said valve means is operated to cause delivery of fuel, a piston in said additional cylinder said piston being subjected at one end to the pressure of liquid at the inlet of the additional cylinder, said piston determining the effective size of said port and means for limiting the rate of movement of the piston in the direction to increase the effective size of said port.

2. An apparatus according to claim 1 in which the means for limiting the rate of movement comprises a restricted oulet from the other end of the additional cylinder.

3. An apparatus according to claim 2 in which said restricted outlet is defined by a sharp edge orifice.

4. An apparatus according to claim 3 in which said orifice communicates with a source of liquid at low pressure whereby said piston will move towards said one end of the additional cylinder when said valve means is set to connect said end of the further cylinder with the drain.

5. An apparatus according to claim 1 in which said port is positioned so as to be covered by said piston prior to operation of said valve means to cause delivery of fuel.

6. An apparatus according to claim 5 in which said valve means comprises a pair of fluid pressure operable valves operable at different pressures, the first of the pair of valves acting when operated to admit fluid to said further cylinder from said source, and the second of the pair of valves when operated serving to prevent fluid flow from said further cylinder, a fluid pressure generator for effecting operation of said valves, a control circuit for said generator whereby the generator can provide a first pressure to cause operation of both valves, a second and lower pressure which effects operation of the second valve and a third and lower pressure at which neither of the valves is operated.

* * * * *